US005148224A

United States Patent [19]

Yamada et al.

[11] Patent Number: 5,148,224

[45] Date of Patent: Sep. 15, 1992

[54] THIN LAYER COATED ENDLESS BELT OF AN ELECTROPHOTOGRAPHIC PRINTING MACHINE

[75] Inventors: Masato Yamada; Junzi Shirakawa; Kazuo Uno, all of Ibaraki, Japan

[73] Assignee: Hitachi Koki Co., Ltd., Tokyo, Japan

[21] Appl. No.: 693,649

[22] Filed: Apr. 30, 1991

[30] Foreign Application Priority Data

May 25, 1990 [JP] Japan ..... 2-135744

[51] Int. Cl.[5] ..... G03G 15/14

[52] U.S. Cl. ..... 355/271; 355/274

[58] Field of Search ..... 355/271, 272, 273, 274, 355/275, 276; 430/48, 126

[56] References Cited

U.S. PATENT DOCUMENTS 4,737,816 4/1988 Inoue et al. .

4,912,516 3/1990 Kaieda ..... 355/274

5,027,159 6/1991 Oda et al. ..... 355/271

*Primary Examiner*—R. L. Moses

*Attorney, Agent, or Firm*—Cushman, Darby & Cushman

[57] ABSTRACT

In an electrophotographic printing machine, the endless belt has a thin protective layer on each of the inner and outer surfaces thereof which is high in mold release characteristic and effective in minimization of the deterioration in electrical characteristic of the endless belt.

2 Claims, 3 Drawing Sheets

THIN LAYER COATED ENDLESS BELT OF AN ELECTROPHOTOGRAPHIC PRINTING MACHINE

BACKGROUND OF THE INVENTION

1. Field of Invention

This invention relates to an electrophotographic printing machine with a high-performance image transferring unit.

2. Description of Related Art

An electrophotographic printing machine has conventionally employed an image transferring system which utilizes corona discharge to transfer a toner image from a photosensitive material onto a recording medium. However, the system has the disadvantage of losing image transferring capability when there is high humidity in the environment. The image transferring capability is also affected when the corona wire is contaminated or the recording medium is creased. In order to eliminate these difficulties, an electrophotographic printing machine has been proposed in which a recording medium onto which an image is to be transferred is pushed against the photo-sensitive material by an endless belt with a volume resistivity of $10^9$ to $10^{14}$ Ω.cm, and the charge on the endless belt is maintained with a corona charging unit on the inner surface of the endless belt. In the conventional electrophotographic printing machine, the image transferring characteristics are greatly affected by the variation in electrical characteristics of the endless belt.

The conventional electrophotographic printing machine will be described with reference to FIG. 4 in more detail. As shown in FIG. 4, an endless belt 1 is laid over a driving roller 2*a* and driven rollers 2*b* and 2*c*, and pulled tight by a tension roller 7 so that a recording medium 6 to which an image is to be transferred is pushed against a photo-sensitive material 3. In order to satisfactorily transfer the image onto the recording medium, the surface potential of the endless belt should be maintained at a suitable value. However, ionic materials formed by the corona discharge of a charging unit 18 or dust in the air are liable to stick to the inner surface of the endless belt 1. This can cause the electrical resistance and dielectric constant of the endless belt to change with time, so that the surface potential is decreased and the amount of flow of charges into the recording medium changes, thus adversely affecting the capability of the endless belt in both its image transferring capabilities and its sheet conveying capabilities. All of these disadvantages of the conventional system result in an endless belt with a relatively short service life.

SUMMARY OF THE INVENTION

Accordingly, an object of this invention is to eliminate the above-described difficulties accompanying a conventional electrophotographic printing machine.

More specifically, an object of the invention is to provide an electrophotographic printing machine in which the variation in electrical characteristics of the endless belt is minimized.

The foregoing object and other objects of the invention have been achieved by the provision of an electrophotographic printing machine comprising: at least two rollers arranged in parallel with each other, at least one of the rollers being grounded; an endless belt $10^9$ to $10^{14}$ Ω.cm in volume resistivity laid over the rollers; a photosensitive material positioned adjacent to the outer surface of the endless belt; an endless belt charging means, positioned on the inner surface of the endless belt; and a transferring means for transferring electro-statically charged toner from the surface of the photo-sensitive material onto a recording medium, in which, according to the invention, the endless belt has a thin protective layer on each of its outer and inner surfaces which is high in mold release characteristics and effective in minimizing the deterioration of the electrical characteristics of the endless belt.

The nature, principle and utility of the invention will become more apparent from the following detailed description when read in conjunction with the accompanying drawings.

BRIEF DESCRIPTION OF THE DRAWINGS

In the accompanying drawings:

FIG. 5(*b*) show the relationship between the density of $NO_3^-$ intruded into a coated belt and the thickness of the coated belt.

DETAILED DESCRIPTION OF THE PREFERRED EMBODIMENTS

One preferred embodiment of this invention, an electrophotographic printing machine, will be described with reference to FIGS. 1, 2 and 3.

Figure 1:
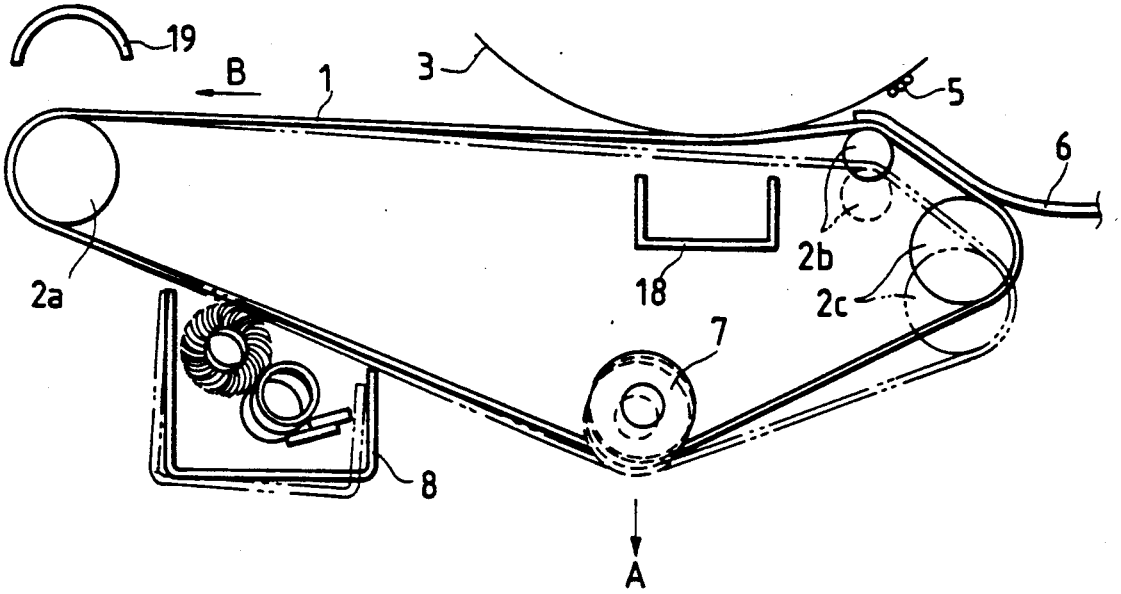
FIG. 1 is a sectional view showing one embodiment of this invention, an electrophotographic printing machine.
Figure 2:
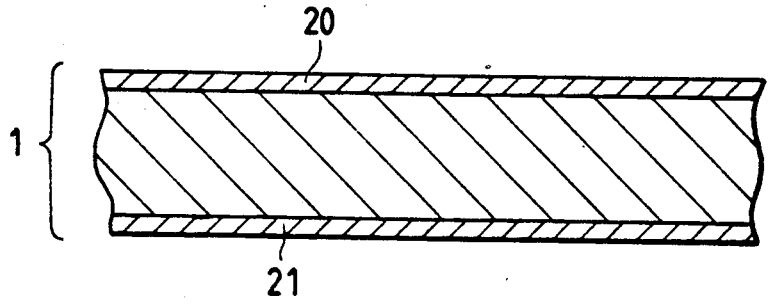
FIG. 2 is a sectional view of an endless belt employed in the printing machine according to the invention.
Figure 3:
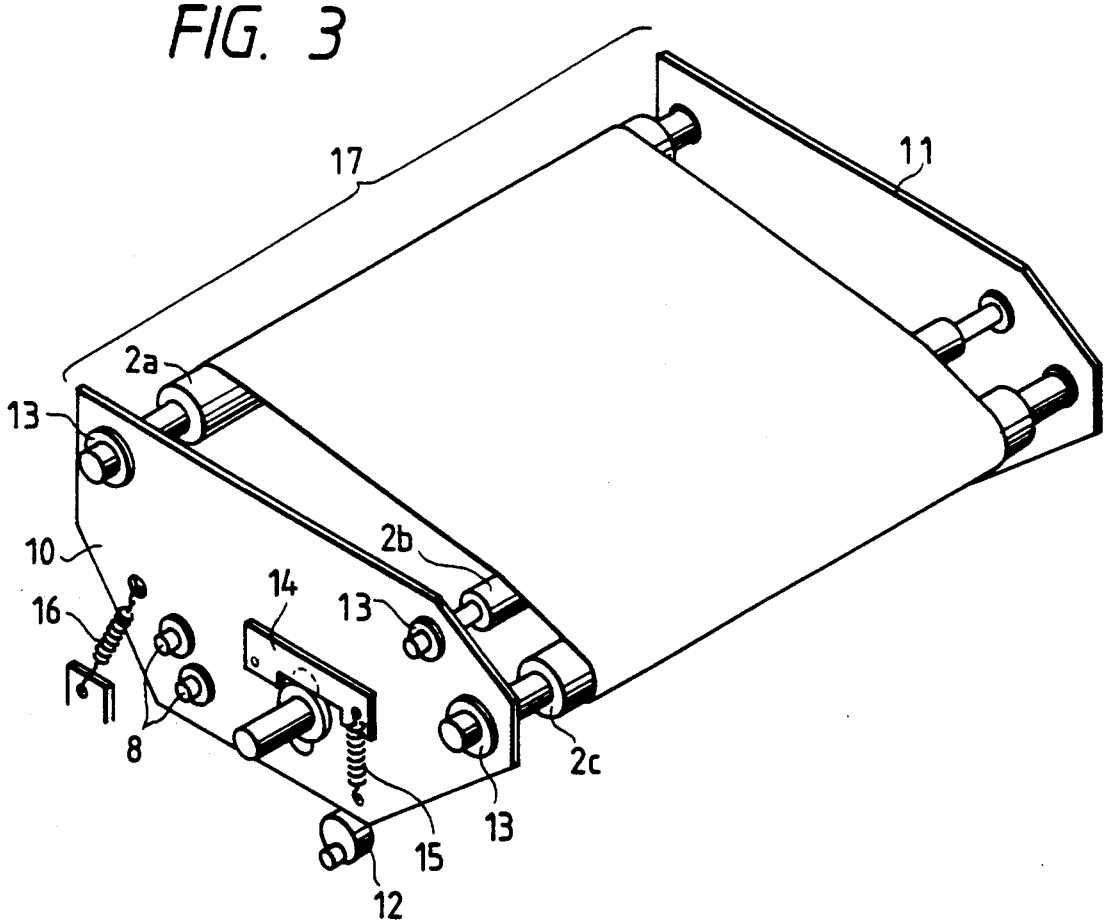
FIG. 3 is a perspective view showing a part of the electrophotographic printing machine according to the invention.
Figure 4:
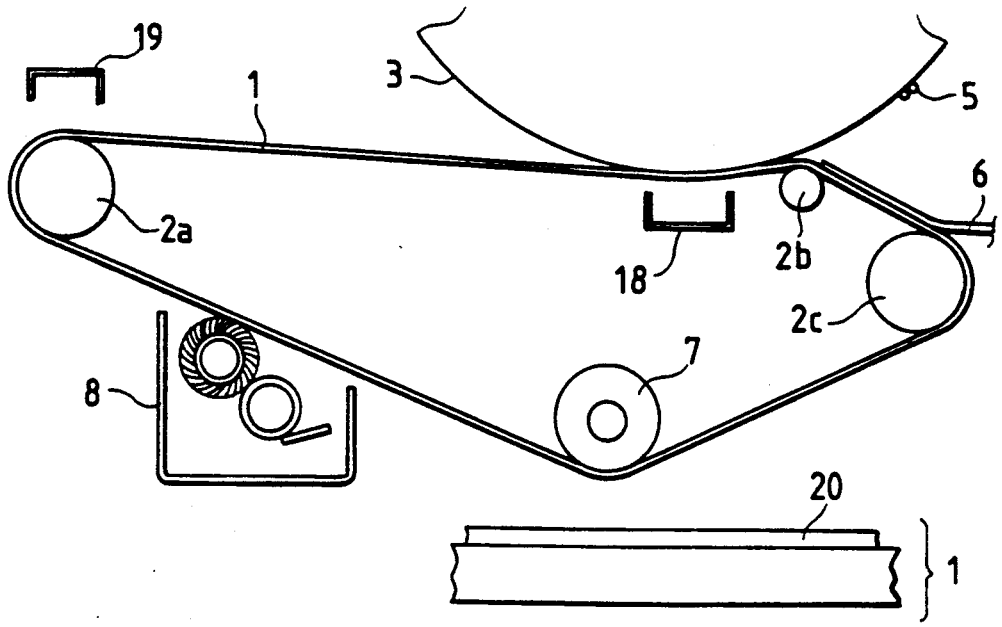
FIG. 4 is a sectional view showing the arrangement of a conventional electrophotographic printing machine.

In the electrophotographic printing machine, as shown in FIGS. 1, 2 and 3, an endless belt 1 is laid over a driving roller 2*a*, driven rollers 2*b* and 2*c* and a tension roller 7 which are supported by side plates 10 and 11 through bearings 13. In the printing operation, the tension roller 7 is pulled in the direction of the arrow A by tensioning members 14 and 15, so that the endless belt 1 is stretched tight. The endless belt thus pulled tight is driven by the driving roller 1*a* in the direction of the arrow B.

Under this condition, a recording sheet 6 is supplied by a sheet supplying unit (not shown), and it is conveyed while being attracted by the endless belt 1 which has been charged by a charging unit 18 on the inner surface of the endless belt. While the recording sheet 6 is being pushed against a drum 3, a toner image 5 is transferred onto the recording sheet 6, and the latter 6 is moved to a fixing unit (not shown) positioned downstream of a developing unit.

Upon completion of the printing operation, the endless belt 1 is stopped, and a cam 12 is turned through 90°, so that the transferring unit 17 is turned about the shaft of the driving roller 2*a* by the elastic force of a spring 16, to move the end-less belt 1 away from the drum 3 as indicated by the two-dot chain lines in FIG. 1.

It is well known in the art that ozone and NOx are formed by corona discharge. If these ionic materials and dust in the air stick to the inner surface of the endless belt, the surface resistance of the endless belt is decreased, so that the charge supplied from the corona charging means leaks to the grounded roller. This results in lowering the image transfer and the sheet conveyance capabilities of the endless roller. Also, the toner is liable to stick to the outer surface of the endless belt. In order to effectively remove the toner from the outer surface of the belt, a thin film which has high mold capabilities is formed on the outer surface of the endless belt.

By forming the same thin film on the both the inner and outer surfaces of the endless belt, the sticking of ionic materials and dust in the air onto the endless belt can be suppressed more effectively, and the variation in electrical characteristics of the endless belt is minimized; that is, the service life of the endless belt is lengthened.

The endless belt 1 is made up of a base layer, and thin protective layers 20 and 21 formed respectively on both sides of the base layer as shown in FIG. 2 (hereinafter referred to as "outer and inner layers 20 and 21", when applicable). In one concrete example of the endless belt 1, the base layer is a urethane rubber layer 0.6 μm in thickness and about $10^{11}$ Ω.cm in electrical resistance, and the outer and inner layers 20 and 21 are each formed by sintering an FLC (Fluoro-Latex Coating) coating 20 μm in thickness and about $10^{13}$ Ω.cm in electrical resistance. In the FLC, the solution such as fluorine, fluorine-based rubber, surface-active agent, etc. are coated by a spray or the like so that a thin rubber layer having fluorine molecules on the surface thereof is formed. As the other method, a thin film of PVdF (Poly-viny lidene-Fluorid) may be formed on the surface of the belt.

Figure 5A:
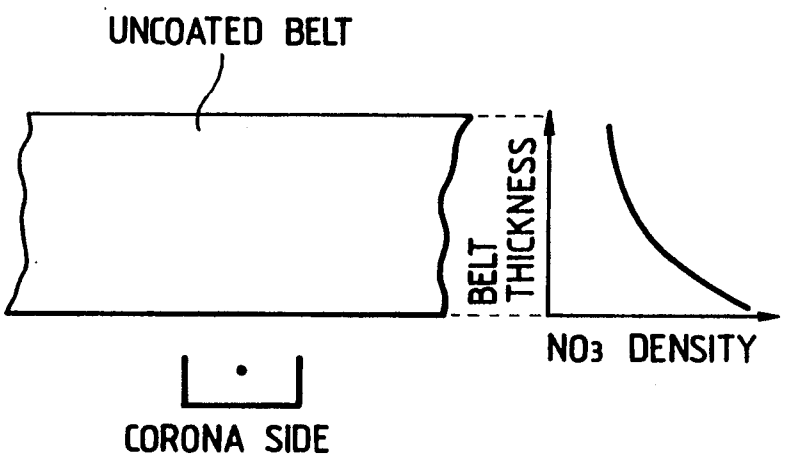
FIG. 5(*a*) shows the relationship between the density of $NO_3^-$ intruded into an uncoated belt and the thickness of the uncoated belt.
Figure 5B:
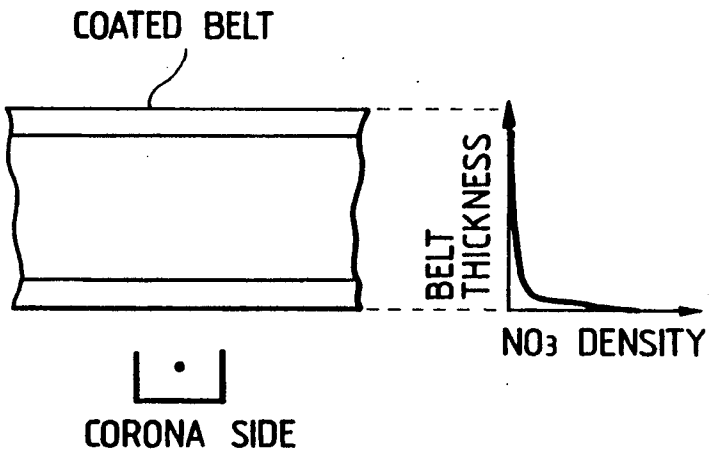

Because fluorine is contained in the protective layer of the FLC or PVdF, the layer is high in mold release characteristics and dust in the air is prevented from sticking to the layer, as a result of which the decrease of the surface resistance of the belt due to sticking of dust is relieved. Further, with the layer of FLC or PVdF, the intrusion of ionic materials such as $NO_3^-$ into the belt is extremely suppressed as shown in FIGS. 5(*a*) and 5(*b*), and the change in the electrical resistance of the belt is reduced.

In the electrophotographic printing machine of the invention, for instance DC 5 kV is supplied to the charging device 18, a corona of AC 10 kV, 500 Hz is applied to the discharging unit 19, and the speed of conveyance of the endless belt is about 300 mm/min.

The thin protective layers 20 and 21 of the endless belt may be formed by bonding or tubing instead of coating.

As was described above, the materials which adversely affect the potential of the endless belt can be readily removed from the endless belt in order to achieve an accurate image transferring operation; that is, the variation with time of the potential of the endless belt can be minimized. Thus, in the electrophotographic printing machine according to the invention, the image transfer capability is maintained unchanged for a long time.

While the above description has been given in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An endless belt of an electrophotographic printing machine which pushes photosensitive material against a recording medium onto which an image is to be transferred, said endless belt being laid over two rollers and being $10^{\circ}$ to $10^{14}$ Ω.cm in volume resistivity and comprising: an inner surface, an outer surface and a thin protective layer covering the inner and outer surfaces, wherein said thin protective layer comprises a fluoro-latex coating 20 μm in thickness and about $10^{13}$ Ω.cm in electrical resistance.

2. An endless belt as claimed in claim 1, in which said thin protective layer contains fluorine, fluorine-based rubber and surface-active agent.

* * * * *